US006236291B1

(12) United States Patent
Sonoda et al.

(10) Patent No.: US 6,236,291 B1
(45) Date of Patent: May 22, 2001

(54) DIELECTRIC FILTER, DUPLEXER, AND COMMUNICATION DEVICE

(75) Inventors: Tomiya Sonoda, Muko; Toshiro Hiratsuka, Kusatsu; Kiyoshi Kanagawa, Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/286,518

(22) Filed: Apr. 6, 1999

(30) Foreign Application Priority Data

Apr. 6, 1998 (JP) ..... 10-093159

(51) Int. Cl.[7] ..... H01P 1/20; H01P 7/10; H01P 5/12

(52) U.S. Cl. ..... 333/202; 333/219.1; 333/134

(58) Field of Search ..... 333/202, 219.1, 333/134

(56) References Cited

U.S. PATENT DOCUMENTS

| | | | | |
|---|---|---|---|---|
| 5,319,329 | | 6/1994 | Shiau et al. | 333/204 |
| 5,446,729 | * | 8/1995 | Jachowski | 333/134 |
| 5,786,740 | * | 7/1998 | Ishikawa et al. | 333/219.1 |
| 6,016,090 | * | 1/2000 | Iio et al. | 333/202 |
| 6,057,745 | * | 5/2000 | Sonoda et al. | 333/134 |

FOREIGN PATENT DOCUMENTS 0734088 9/1996 (EP) .

0841714 5/1998 (EP) .

OTHER PUBLICATIONS

European Search Report dated Jun. 26, 2000.

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

A dielectric filter includes a case, a substrate having microstrip lines formed thereon, and a dielectric plate having non-electrode parts serving as dielectric resonators. The case includes a supporting part for supporting the lower surface of the dielectric plate and includes a side wall surrounding the side faces of the dielectric plate wherein the supporting part and the side wall are formed in an integral fashion. The substrate is bonded to the case and the dielectric plate is mounted on the supporting part of the case. A metal cover is then placed on the case such that the opening of the case is closed with the cover. In the dielectric filter constructed in the above-described manner, warping of the case for supporting the dielectric plate is suppressed and thus the stress exerted on the dielectric plate is reduced. As a result, the dielectric plate is prevented from being separated from the case and also prevented from having a crack. The above-described structure also allows the dielectric filter to be formed into a small size. The invention also provides a duplexer and a communication device using such a dielectric filter.

10 Claims, 6 Drawing Sheets

DIELECTRIC FILTER, DUPLEXER, AND COMMUNICATION DEVICE

BACKGROUND OF THE INVENTION

1. Field of the Invention

The present invention relates to a dielectric filter for use in a microwave range or a millimeter wave range and also to a duplexer and a communication device using such a dielectric filter.

2. Description of the Related Art

There is an increasing need for a high-capacity and high-speed communication system. To meet such a need, the communication frequency band is being expanded from the microwave band to the millimeter wave band. In particular, the submillimeter wave band is attractive for various applications such as a wireless LAN, a portable video telephone, and a next-generation satellite broadcasting system. As the frequency band expands, a filter is required which is small in size, inexpensive, and suitable for use in a planar circuit. In view of the above, the inventors of the present invention have proposed a "submillimeter wave band-pass filter using a planar-circuit dielectric resonator" (Proceedings of Conference of the Institute of Electronics, Information, and Communications Engineers, 1996, C-121).

The structure of this dielectric filter is shown in an exploded perspective fashion in FIG. 8. In FIG. 8, reference numeral 3 denotes a dielectric plate having electrodes formed on its respective two principal surfaces wherein each electrode is partially removed so as to form non-electrode areas. The non-electrode areas of each electrode are formed at locations corresponding to those of the opposite electrode. In FIG. 8, reference numeral 1 denotes an electrode formed on a surface, on the upper side in FIG. 8, of the dielectric plate 3, and reference numerals 4*a*, 4*b*, and 4*c* denote non-electrode areas. Reference numerals 6 and 7 denote a substrate and a frame, respectively. Both the substrate 6 and the frame 7 are made of ceramic. An electrode is formed on the lower surface of the substrate. An electrode is also formed in the peripheral area 11, outside the frame 7, of the upper surface of the substrate. Furthermore, an electrode is formed on the external side faces of the frame 7. Reference numeral 8 denotes a cover also made of ceramic wherein an electrode is formed on its surface in contact with the electrode 1 and an electrode is also formed on the side faces of the cover. Microstrip lines 9 and 10 serving as probes and also as input/output terminals are formed on the upper surface of the substrate 6.

In the above-described structure, parts of the dielectric plate 3 located between the respective two opposing non-electrode areas serve as TE010-mode dielectric resonators wherein adjacent dielectric resonators are coupled with each other and each resonator is also coupled with the microstrip line 9 or 10.

Because the conventional dielectric filter shown in FIG. 8 has a structure in which the dielectric plate 3 including the dielectric resonators is located between the frame 7 and the cover 8, when the frame 7 is soldered to the substrate 6 to form a single unit, the resultant unit has a warp due to the difference between the linear expansion coefficient of the frame 7 and that of the substrate 6. The dielectric plate 3 having a modulus of elasticity similar to those of the frame 7 and the cover 8 is bonded together with the cover 8 to the upper side of the warped frame 7 via a conductive adhesive. Thus, after these elements are combined together, a stress occurs due to the difference in linear expansion coefficient between the frame 7 and the cover 8 and also due to the warping of the frame 7. The stress can cause the frame 7 or the cover 8 to be separated from the dielectric plate 8. The stress can also cause the dielectric plate 3 to have a crack. Even when the dielectric plate does not encounter separation or crack in normal environments, the stress can cause a reduction in environmental resistance.

Although the rigidity of the frame 7 can be increased by increasing the wall thickness of the frame 7, the result is an increase in the overall size. On the other hand, if the height the frame 7 is increased, the result is an increase in the distance between the probes and the corresponding resonators, which makes it impossible to obtain desired external coupling. As a result it becomes impossible to achieve desired characteristics.

In view of the above, it is an object of the present invention to provide a dielectric filter no longer having the above-described problems. It is another object of the invention to provide a duplexer and a communication device using such a dielectric filter.

SUMMARY OF THE INVENTION

According to an aspect of the present invention, there is provided a dielectric filter including a case, a dielectric plate, and a cover. The case has a supporting part for supporting one surface of the dielectric plate and a side wall surrounding the side faces of the dielectric plate wherein the supporting part and the side wall are formed in an integral fashion. The cover is placed on the case such that the opening of the case is closed with the cover thereby forming a part of a cavity. In this structure, the stress between the dielectric plate and the case is suppressed.

By forming the supporting part for supporting the dielectric plate including the dielectric resonator and the side wall surrounding the side faces of the dielectric plate in the integral fashion as described above, it becomes possible to increase the rigidity of the case thereby ensuring that the case has a warp to a reduced degree when the case is bonded to the substrate. As a result, the dielectric plate has less stress in a part where the dielectric plate is supported. Furthermore, because the dielectric plate is supported by the supporting part of the case in such a manner that only one surface of the dielectric plate is in contact with the supporting part, the dielectric plate has less stress due to the difference of the linear expansion coefficient of the dielectric plate from that of the case or the cover than will occur in a structure in which both the upper and lower surfaces of the dielectric plate are in contact with the case and cover, respectively, as in the conventional technique.

In the present invention, the supporting part of the case for supporting the dielectric plate preferably includes a recess for preventing a corner of the dielectric plate from being in contact with the supporting part. As opposed to the conventional structure in which the stress due to the difference in the linear expansion coefficient is most concentrate in the corners of the dielectric plate, the structure according to the invention allows the corner of the dielectric plate to have a reduced stress. As a result, the stress is also reduced over the entire region of the dielectric plate.

Furthermore, in the present invention, a corner of the dielectric plate is preferably cut off or rounded so that the stress in the corner of the dielectric plate is deconcentrated.

The present invention also provides a duplexer including a transmitting filter, a receiving filter, transmission signal input port, an input/output port, and a reception signal output port, wherein either one of or both of the transmitting and receiving filters are realized using a dielectric filter according to any of aspects of the invention, and wherein the transmitting filter is disposed between the transmission signal input port and the input/output port, and the receiving filter is disposed between the reception signal output port and the input/output port.

According to the present invention, it is possible to achieve high rigidity without having to increase the thickness of the side wall surrounding the side faces of the dielectric plate and thus it becomes possible to realize a small-sized dielectric filter and also a small-sized duplexer.

The invention also provides a communication device including the above-described duplexer, a transmitting circuit, and a receiving circuit, wherein the transmitting circuit is connected to the transmission signal input port of the duplexer and the receiving circuit is connected to the reception signal output port of the duplexer.

DESCRIPTION OF THE PREFERRED EMBODIMENTS

Figure 1:
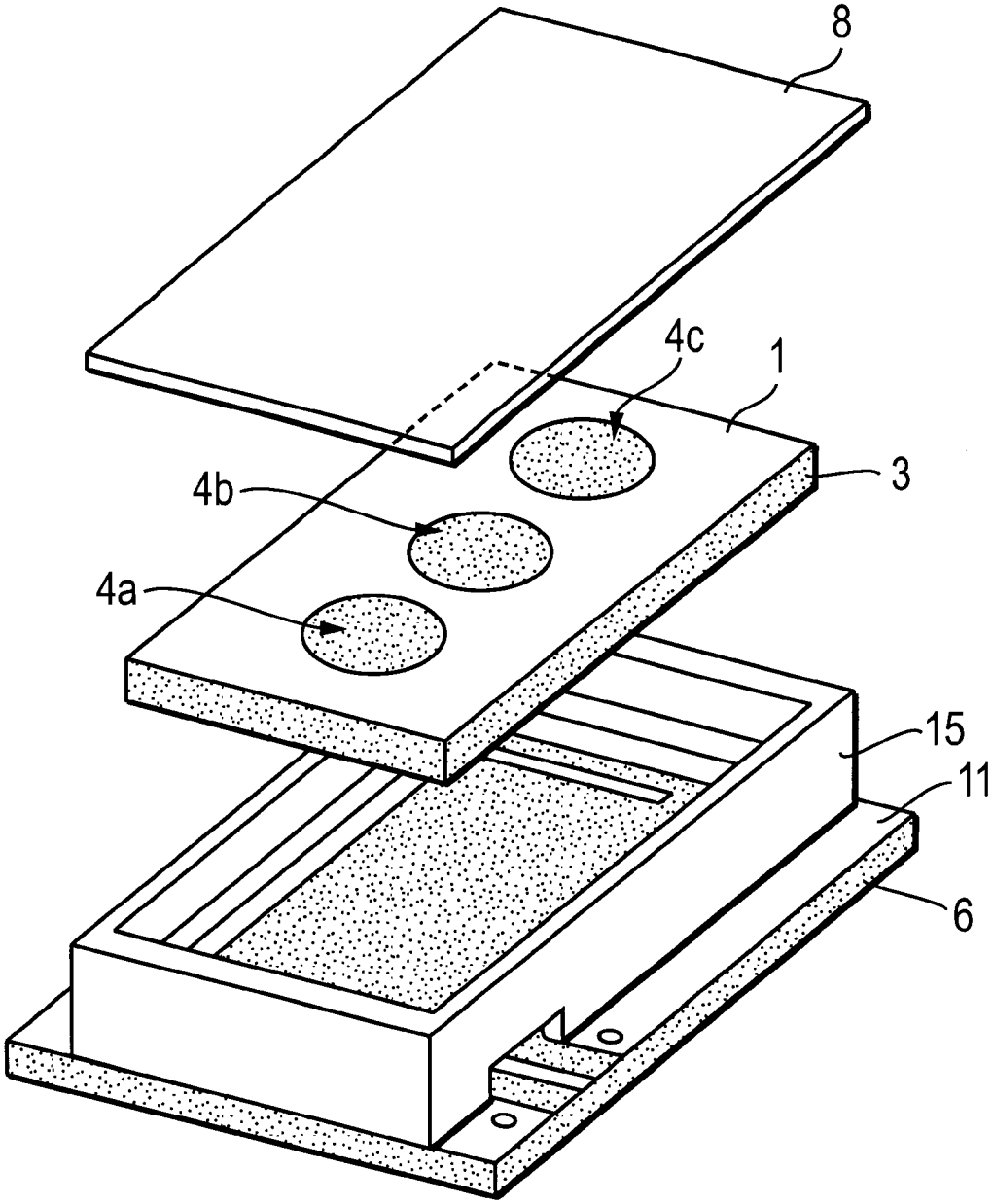
FIG. 1 is an exploded perspective view of a dielectric filter according to a first embodiment of the invention.
Figure 2A:
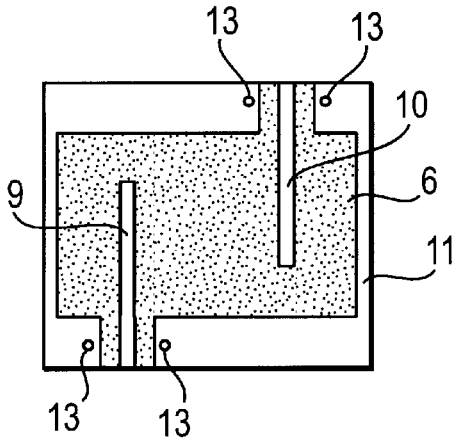
FIGS. 2A to 2C are plan views illustrating the dielectric filter in various states during assembling steps.
Figure 2B:
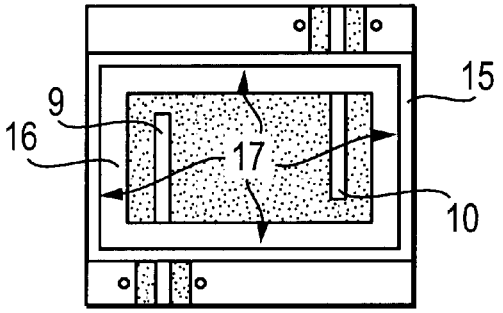
Figure 2C:
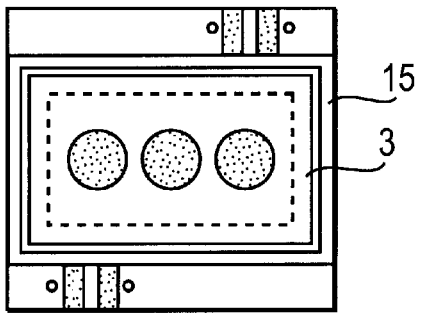
Figure 3:
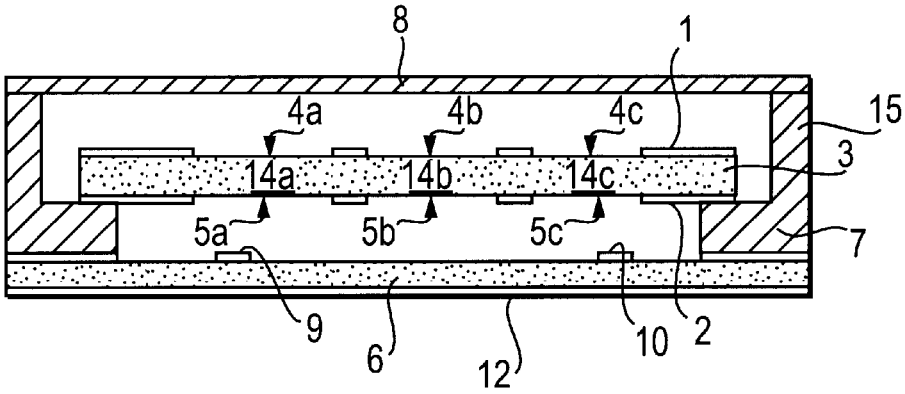
FIG. 3 is a cross-sectional view of the dielectric filter.

Referring to FIGS. 1 to 3, a first embodiment of a dielectric filter according to the invention is described below.

FIG. 1 is an exploded perspective view of the dielectric filter and FIG. 3 is a cross-sectional view thereof taken in the longitudinal direction. In FIGS. 1 and 3, reference numeral 3 denotes a dielectric plate made of dielectric ceramic having a linear expansion coefficient of for example 11 ppm/EC. An electrode 1 having non-electrode areas 4*a*, 4*b*, and 4*c* are formed on the upper surface of the dielectric plate 3. An electrode 2 are disposed on the lower surface of the dielectric plate 3 wherein non-electrode areas 5*a*, 5*b*, and 5*c* which are equal in shape to the non-electrode areas 4*a*, 4*b*, and 4*c* are formed in the electrode 2 at locations corresponding to the respective non-electrode areas 4*a*, 4*b*, and 4*c*. The regions 14*a*, 14*b*, 14*c* defined between the respective opposing non-electrode areas serve as TE010-mode dielectric resonators. The resonance frequencies of the dielectric resonators are set for example to 19 GHz.

Reference numeral 15 denotes a case disposed such that the dielectric plate 1 is surrounded by the is case 15 and the dielectric plate 1 is supported by the case 15.

The case 15 is formed using an iron-based material such as S45C so as to have a linear expansion coefficient matched with that of the dielectric plate 3. The surface of the case 15 is plated with Ag or Au. Reference numeral 8 denotes a cover with which the upper side of the case 8 is covered. As with the case 15, the cover 8 is also made of an iron-based material and its surface is plated with Ag or Au.

In FIGS. 1 and 3, reference numeral 6 denotes a substrate. An electrode 12 is formed over the substantially entire area of the lower surface of the substrate 2. An electrode 11 is formed in a peripheral area of the upper surface of the substrate 6. Furthermore, microstrip lines 9 and 10 are formed on the upper surface of the substrate 6 wherein a part of each microstrip line serves as a probe (coupling member). A cavity is formed with the case 15, the cover 8, and the electrode 12 on the lower surface of the substrate 6.

In order to produce the substrate 6 at low cost and also to improve the productivity, it is preferable to employ, for example, a printed circuit substrate covered with copper foils designed for use in high-frequency applications. In this case, because the linear expansion coefficient of the copper foils on the substrate is about 17 ppm/EC and thus there is a difference between the linear expansion coefficient of the copper foils and that of the case 15. Therefore, when the case and the substrate are soldered to each other for example at 200 EC, the substrate (copper foils) 11 tries to contracts to a greater degree than the case 15 and thus a stress occurs. However, because the case 15 is formed such that the supporting part for supporting the dielectric plate 3 and the side wall are formed in the integral fashion, the case 15 has a large total cross-sectional area and a large height. This structure allows the case 15 to have an extremely large strength against the bending stress compared to the conventional dielectric filter shown in FIG. 8. As a result, the case 15 is prevented from being warped. Therefore, when the dielectric plate 3 is mounted on the supporting part of the case 15, the stresses exerted on the four corners of the dielectric plate 3 are reduced to as low as one third those occurring in the conventional structure shown in FIG. 8.

FIGS. 2A to 2C are plan views illustrating relative positional relationships among the substrate, the case, and the dielectric plate, wherein FIG. 2A is a plan view illustrating the substrate disposed separately from the other elements before being assembled. FIG. 2B is a plan view illustrating the substrate combined with the case, and FIG. 2C is a plan view illustrating the state where the dielectric plate is further combined.

As can be seen from FIG. 2A, the electrode 11 and the microstrip lines 9 10 serving as probes are formed on the upper surface of the substrate 6. The substrate 6 has through-holes 13 formed near external leading portions of the microstrip lines 9 and 10 so that the upper electrode 11 and the lower electrode are electrically connected to each other via the through-holes 13. Although not shown in the figure, through-holes are also formed in areas where the substrate 11 is connected to the case 15. These through-holes prevent the microstrip lines 9 and 10 from being coupled with undesirable resonance occurring between the two electrodes formed on the upper and lower surfaces of the substrate 6.

The substrate shown in FIG. 2A is bonded to the case 15 by soldering the case 15 to the upper surface of the substrate as shown in FIG. 2B. The dielectric plate 3 is then combined by bonding the lower surface of the dielectric plate 3 to the supporting part 16 of the case 15 via a conductive adhesive or the like as shown in FIG. 2C. The external size of the dielectric plate 3 is set to a value slightly smaller than the inner size of the side wall of the case 15 so that the side faces of the dielectric plate 3 does not come into tight contact with the side wall of the case 15. Thus, the dielectric plate 3 is supported by the case 15 in such a manner that only the peripheral area of the lower surface of the dielectric plate 3 is in contact with the case 15.

Figure 8:
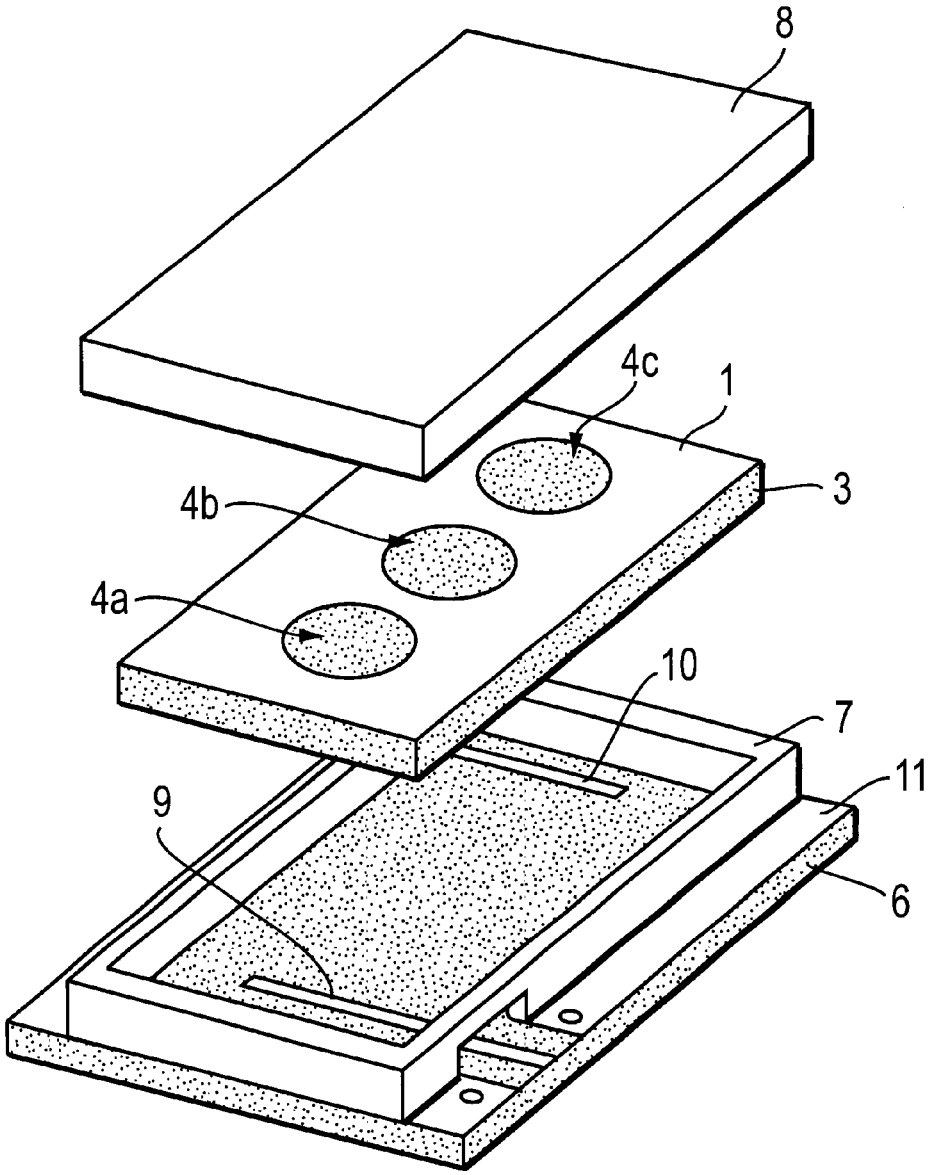
FIG. 8 PRIOR ART
FIG. 8 is an exploded perspective view of a conventional dielectric filter.

In the conventional dielectric filter, although not shown in FIG. 8, after placing the dielectric plate 3 such that its peripheral part is sandwiched between the frame 7 and the cover 8, a ground plate is bonded to the side faces of the frame 7 and cover 8 so that they are grounded and so that the dielectric plate is electromagnetically shielded by the ground plate. In contrast, in the present invention, as can be seen from the above description with reference to the embodiment, the dielectric plate is disposed within the cavity and thus no ground plate is needed to be bonded. Therefore, it is possible to reduce the number of components and also the number of processing steps. In the first embodiment, because no electrode is formed on the end faces of the dielectric plate 3, the upper electrode 1 is isolated from the ground. However, in TE modes such as a TE010 mode, the return current does not flow across the side wall and thus it is not necessarily required that the electrodes formed on the upper and lower surfaces of the dielectric plate be DC connected. The isolation of the upper electrode 1 from the ground can cause a spurious problem. However, in practice, no significant degradation of characteristics in terms of the insertion loss and the attenuation characteristic is observed in actual evaluations. That is, the spurious is as low as required in practical applications.

Figure 4A:
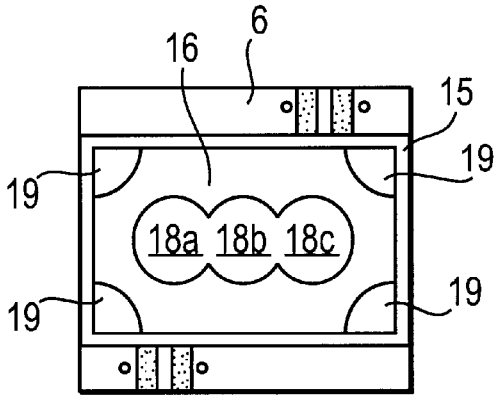
FIGS. 4A and 4B are plan views illustrating a dielectric filter according to a second embodiment of the invention.
Figure 4B:
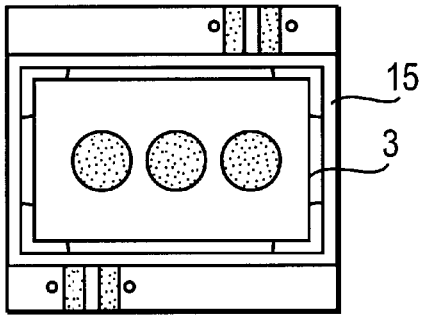

FIGS. 4A and 4B illustrate a second embodiment of a dielectric filter according to the invention wherein FIG. 4A is a plan view illustrating a substrate 6 placed in a case 15 and FIG. 4B is a plan view illustrating the state in which a dielectric 3 is further combined. In this embodiment, recesses 19 are formed in the four corners of the supporting part 16 of the case 15 such that the height of each corner becomes lower than the height of the other parts of the supporting part 16. When the dielectric plate 3 is mounted as shown in FIG. 4B, the recesses allow the four corners of the dielectric plate 3 to be spaced slightly away from the supporting part 16 and thus the four corners of the dielectric plate 3 encounter a less stress due to the warp of the case 15.

As shown in FIG. 4A, there are spaces 18*a*, 18*b*, and 18*c*, formed at locations corresponding to the TE010-mode dielectric resonators. The sizes of these spaces 18*a*, 18*b*, and 18*c* are determined such that when these spaces are regarded as resonant spaces, the cut-off frequencies of the resonant spaces become higher than the resonance frequencies of the resonators formed in the dielectric plate and also such that the sizes of the spaces 18*a*, 18*b*, and 18*c* are greater than the outer sizes of the non-electrode areas formed on the dielectric plate, thereby suppressing undesired resonance modes in the space between the substrate 6 and the dielectric plate 3 and thus providing improved spurious characteristics. The spaces 18*a*, 18*b*, and 18*c* may be produced by means of cutting, etching, or other techniques at the same time as the recesses 19 are formed during the process of producing the case 15.

Figure 5A:
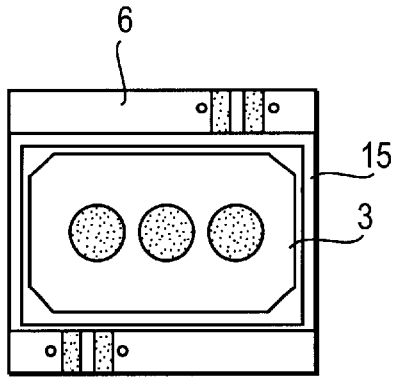
FIGS. 5A and 5B are plan views illustrating a dielectric filter according to a third embodiment of the invention.
Figure 5B:
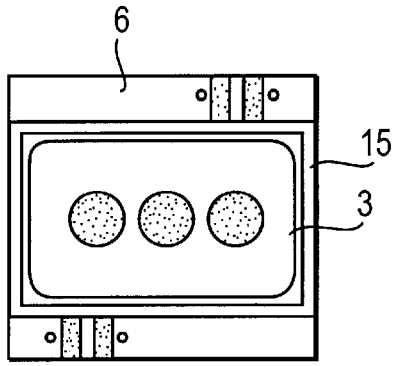

FIGS. 5A and 5B illustrate two examples of dielectric filters according to a third embodiment of the invention. Plan views of dielectric plates 3 placed in respective cases 15 are shown. In the example shown in FIG. 5A, the corners of the dielectric plate 3 are cut off in such a manner as to form so-called C-faces. In the example shown in FIG. 5B, the corners of the dielectric plate 3 are rounded in such a manner as to form R-corners. In both examples, stresses in the four corners of the dielectric plate 3 placed in the case 15 are deconcentrated and thus cracks are prevented from occurring.

Figure 6:
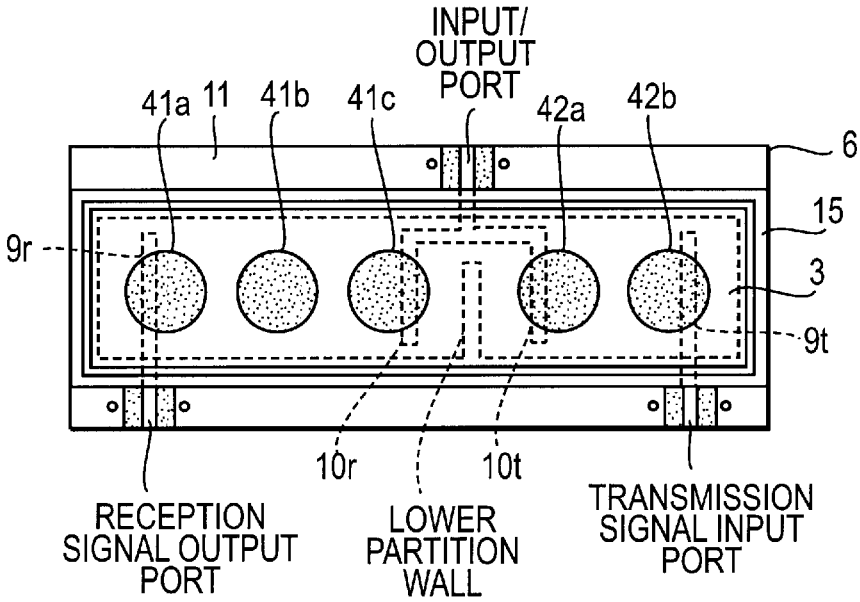
FIG. 6 is a plan view of a duplexer according to a fourth embodiment of the invention.

FIG. 6 illustrates a duplexer according to a fourth embodiment of the invention wherein the state in which a substrate 6 is bonded to a case 15 and a dielectric plate 3 is further placed in the case 15 is shown in the form of a plan view. An electrode having five non-electrode areas 41*a*, 41*b*, 41*c*, 42*a*, and 42*b* are formed on the upper surface of the dielectric plate 3 and an electrode having non-electrode areas formed at locations opposing the non-electrode areas 41*a*, 41*b*, 41*c*, 42*a*, and 42*b* are disposed on the lower surface of the dielectric plate 3 thereby forming five TE010-mode dielectric resonators. Of these dielectric resonators, three dielectric resonators formed at locations defined by the non-electrode areas 41*a*, 41, and 41*c* are used to form a 3-stage receiving filter. The remaining two resonators formed at locations defined by the non-electrode areas 42*a* and 42*b* are used to form a 2-stage transmitting filter.

As shown in FIG. 6, the case 15 has a lower partition wall projecting inward so as to provide isolation between the receiving filter and the transmitting filter. The upper side of the case 15 is covered with a cover similar to that shown in FIG. 1. The cover has an upper partition wall formed on its inner surface at a location opposing the lower partition wall such that the dielectric plate 3 is placed between the upper and lower partition walls. In this structure, the dielectric resonators are surrounded by the electrode on the lower surface of the substrate 6, the case 15, the cover, and the upper and lower partition walls whereby the dielectric resonators are electromagnetically shielded and the transmitting and receiving filters are isolated from each other.

Four microstrip lines 9*r*, 10*r*, 10*t*, and 9*t* serving as probes are formed on the substrate 6. The end portions of the microstrip lines 9*r* and 9*t* serve as a reception signal output port and a transmission signal input port, respectively. The end portions of the microstrip lines 10*r* and 10*t* are connected to each other via a dividing microstrip line which serves as an input/output port extending outward. The electrical length for each microstrip line 10*r*, 10*t*, between the equivalent short-circuited plane and the dividing point is determined so that the receiving filter has a high impedance at the transmitting frequency when seen from the dividing point and so that the transmitting filter also has a high impedance at the receiving frequency when seen from the dividing point.

Even in the case where a large number of resonators are disposed on a single substrate as in this embodiment, the invention can allows the case 15 to have high enough rigidity which prevents the dielectric plate 3 from having a crack. Thus, it is possible to realize a high-reliability duplexer.

Figure 7:
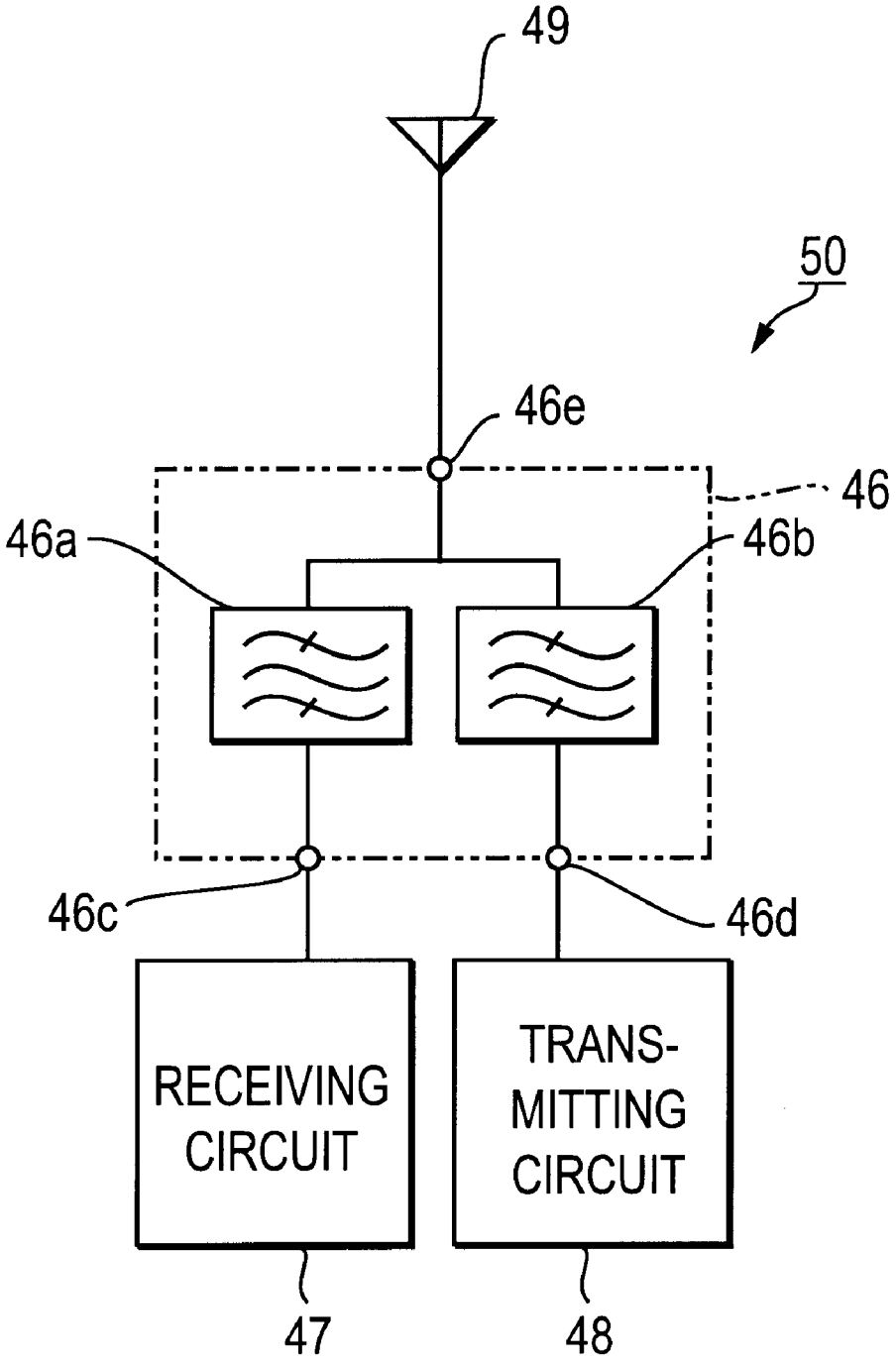
FIG. 7 is a block diagram of a communication device according to a fifth embodiment of the invention.

FIG. 7 illustrates an embodiment of a communication device using the above-described duplexer as an antenna duplexer. In FIG. 7, reference numeral 46 denotes the antenna duplexer including receiving and transmitting filters 46*a* and 46*b* of the above-described type. As shown in FIG. 7, a receiving circuit 47 is connected to the reception signal output port 46*c* of the antenna duplexer 46, a transmitting circuit 48 is connected to the transmission signal input port 46*d*, and an antenna 49 is connected to the antenna port 46*e* so that they act, as a whole, as a communication device 50. This communication device may be employed for example in a high-frequency circuit of a portable telephone or the like.

As described above, by employing the duplexer using the dielectric filter according to the invention, it becomes possible to realize a communication device with a small-sized duplexer. The receiving filter 46*a* and the transmitting filter 46*b* of the duplexer 46 may also be formed in a separate fashion similar to the dielectric filter shown in FIG. 1.

As can be seen from the above description, the present invention has various advantages. That is, the case for supporting the dielectric plate and accommodating it has increased rigidity which prevents the case from being warped when the case is bonded to the substrate. Furthermore, because the dielectric plate is supported by the case in such a manner that only one surface of the dielectric plate is in contact with the case, the dielectric plate has a less stress due to the difference between the linear expansion coefficient of the dielectric plate and that of the case or the cover. As a result, the dielectric plate is prevented from encountering separation or a crack. Furthermore, it is possible to increase the rigidity of the case without having to increase the thickness of the side wall surrounding the side faces of the dielectric plate. This makes it possible to realize a dielectric filter with a reduced size.

Still furthermore, because the supporting part of the case has recesses so that the corners of the dielectric plate are prevented from being in direct contact with the case. This allows the corners of the dielectric plate to have deconcentrated stresses and thus ensuring that the dielectric plate is prevented from encountering separation or cracks.

Still furthermore, by forming the dielectric plate into a shape in which the corners of the dielectric plate are cut off or rounded, the stresses in the corners of the dielectric plate are deconcentrated and thus the dielectric plate is prevented in a more reliable fashion from encountering separation or cracks.

Still furthermore, the dielectric filter according to the invention may be used to form either one of or both of transmitting and receiving filters thereby realizing a small-sized duplexer in which the transmitting filter is disposed between the transmission signal input port and the input/output port, and the receiving filter is disposed between the reception signal output port and the input/output port.

Still furthermore, it is also possible to realize a small-sized communication device including a high-frequency circuit with a reduced size, by connecting a transmitting circuit to the transmission signal input port of the above-described duplexer and connecting a receiving circuit to the reception signal output port of the duplexer and finally connecting an antenna to the input/output port of the duplexer.

What is claimed is:

1. A dielectric filter comprising:

electrodes formed on two respective principal surfaces of a dielectric plate, each electrode having a non-electrode area substantially equal in shape to a non-electrode area of the other electrode, wherein the respective non-electrode areas of said electrodes are formed at locations opposing each other such that a region between said opposing non-electrode areas serves as a resonance region;

a coupling member coupled to said resonance region;

a cavity having a space surrounding said resonance region and said coupling member;

a case including a supporting part for supporting one surface of said dielectric plate, said case also including a side wall surrounding side faces of said dielectric plate, said supporting part and said side wall being integral with each other; and a cover placed on said case such that an opening of said case is closed with said cover, wherein said case and said cover form a part of said cavity.

2. A dielectric filter comprising:

electrodes formed on two respective principal surfaces of a dielectric plate, each electrode having a non-electrode area substantially equal in shape to a non-electrode area of the other electrode, wherein the respective non-electrode areas of said electrodes are formed at locations opposing each other such that a region between said opposing non-electrode areas serves as a resonance region;

a coupling member coupled to said resonance region;

a cavity having a space surrounding said resonance region and said coupling member;

a case including a supporting part for supporting one surface of said dielectric plate, said case also including a side wall surrounding side faces of said dielectric plate, said supporting part and said side wall being integral with each other; and a cover placed on said case such that an opening of said case is closed with said cover, wherein said case and said cover form a part of said cavity;

wherein said supporting part includes a recess for preventing a corner of said dielectric plate from being in contact with said supporting part.

3. A dielectric filter comprising:

electrodes formed on two respective principal surfaces of a dielectric plate, each electrode having a non-electrode area substantially equal in shape to a non-electrode area of the other electrode, wherein the respective non-electrode areas of said electrodes are formed at locations opposing each other such that a region between said opposing non-electrode areas serves as a resonance region;

a coupling member coupled to said resonance region;

a cavity having a space surrounding said resonance region and said coupling member;

a case including a supporting part for supporting one surface of said dielectric plate, said case also including a side wall surrounding side faces of said dielectric plate, said supporting part and said side wall being integral with each other; and a cover placed on said case such that an opening of said case is closed with said cover, wherein said case and said cover form a part of said cavity;

wherein a corner of said dielectric plate is cut off or rounded.

4. A duplexer including a transmitting filter, a receiving filter, transmission signal input port, an input/output port, and a reception signal output port, wherein either one of or both of said transmitting and receiving filters are realized using a dielectric filter according to any of claims 1 to 3, and wherein said transmitting filter is disposed between said transmission signal input port and said input/output port, and said receiving filter is disposed between said reception signal output port and said input/output port.

5. A communication device including a duplexer according to claim 4, a transmitting circuit, and a receiving circuit, wherein said transmitting circuit is connected to the transmission signal input port of said duplexer and said receiving circuit is connected to the reception signal output port of said duplexer.

6. A communication device according to claim 5, further comprising an antenna connected to said input/output port.

7. A dielectric filter according to claim 1, wherein only one surface of the dielectric plate is disposed in contact with said case.

8. A dielectric filter according to claim 2, wherein only one surface of the dielectric plate is disposed in contact with said case.

9. A dielectric filter according to claim 3, wherein only one surface of the dielectric plate is disposed in contact with said case.

10. A duplexer according to claim 4, wherein only one surface of the dielectric plate is disposed in contact with said case.

* * * * *